US005913837A

United States Patent [19]

Smith

[11] Patent Number: 5,913,837

[45] Date of Patent: Jun. 22, 1999

[54] AUTOMATIC CARDIAC COMPRESSION SYSTEM

[76] Inventor: Dexter M. Smith, Box 278, Pinedale, Wyo. 82941

[21] Appl. No.: 09/083,563

[22] Filed: May 22, 1998

[51] Int. Cl.[6] ..... A61H 31/00

[52] U.S. Cl. ..... 601/41; 601/97; 601/134

[58] Field of Search ..... 601/1, 41, 42, 601/43, 44, 89, 97, 134, 135, 105–107; 434/265

[56] References Cited

U.S. PATENT DOCUMENTS

| | | | |
|---|---|---|---|
| 3,489,140 | 1/1970 | Mullikin | 601/41 |
| 3,739,771 | 6/1973 | Gaquer et al. | 601/41 |
| 4,166,458 | 9/1979 | Harrigan | 601/1 |
| 4,338,924 | 7/1982 | Bloom | 601/41 |
| 5,257,619 | 11/1993 | Everette | 601/41 |
| 5,327,887 | 7/1994 | Nowakowski | 601/41 |
| 5,634,886 | 6/1997 | Bennett | 601/41 |

*Primary Examiner*—Jeanne M. Clark

[57] ABSTRACT

An automatic cardiac compression system that is portable, simple to install on a patient and provides effective cardiac compression on a wide range of patient sizes. The inventive device includes a housing including a removable board with straps, an arcuate arm pivotally attached to the housing, a reciprocating transmission attached to the arcuate arm by an adjustable connector, a variable speed motor mechanically connected to the reciprocating transmission, and a battery electrically connected to the variable speed motor. The user positions the patient upon the removable board with the sternum positioned directly below the distal end of the arcuate arm. The user then manipulates a control switch which operates the variable speed motor. The motor manipulates the arcuate arm so that the arcuate arm repeatedly engages the patient's chest to provide cardiac compression. After the patient is resuscitated, the user manipulates the switch to terminate power to the motor thereby terminating movement of the arcuate arm.

14 Claims, 5 Drawing Sheets

AUTOMATIC CARDIAC COMPRESSION SYSTEM

BACKGROUND OF THE INVENTION

1. Field of the Invention

The present invention relates generally to resuscitation devices and more specifically it relates to an automatic cardiac compression system that is portable, simple to install on a patient and provides effective cardiac compression on a wide range of patient sizes.

2. Description of the Prior Art

There are numerous resuscitation devices. For example, U.S. Pat. No. 5,327,887 to Nowakowski; U.S. Pat. No. 5,257,619 to Everete; U.S. Pat. No. 4,338,924 to Bloom are all illustrative of such prior art.

Nowakowski (U.S. Pat. No. 5,327,887) discloses a cardiopulmonary resuscitation device which is portable and self-contained. Nowakowski teaches a base which adjustably supports a thumper which repeatedly engages the chest of a patient along with a ventilator.

Everete (U.S. Pat. No. 5,257,619) discloses an external cardiac compression device for applying manual external cardiac massage. Everete teaches a base, a vertical support member, and an arm pivotally attached to the vertical support member with a flanged shaft extending downwardly therefrom for engaging the patient's chest.

While these devices may be suitable for the particular purpose to which they address, they are not as suitable for providing an automatic cardiac compression system that is portable, simple to install on a patient and provides effective cardiac compression on a wide range of patient sizes.

In these respects, the automatic cardiac compression system according to the present invention substantially departs from the conventional concepts and designs of the prior art, and in so doing provides an apparatus primarily developed for the purpose of providing an automatic cardiac compression system that is portable, simple to install on a patient and provides effective cardiac compression on a wide range of patient sizes.

SUMMARY OF THE INVENTION

A primary object of the present invention is to provide an automatic cardiac compression system that will overcome the shortcomings of the prior art devices.

Another object is to provide an automatic cardiac compression system that is portable.

An additional object is to provide an automatic cardiac compression system that provides automatic external cardiac massage.

A further object is to provide an automatic cardiac compression system that can be quickly disassembled into a compact storage unit.

Another object is to provide an automatic cardiac compression system that is adjustable for various sizes of patient chests.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
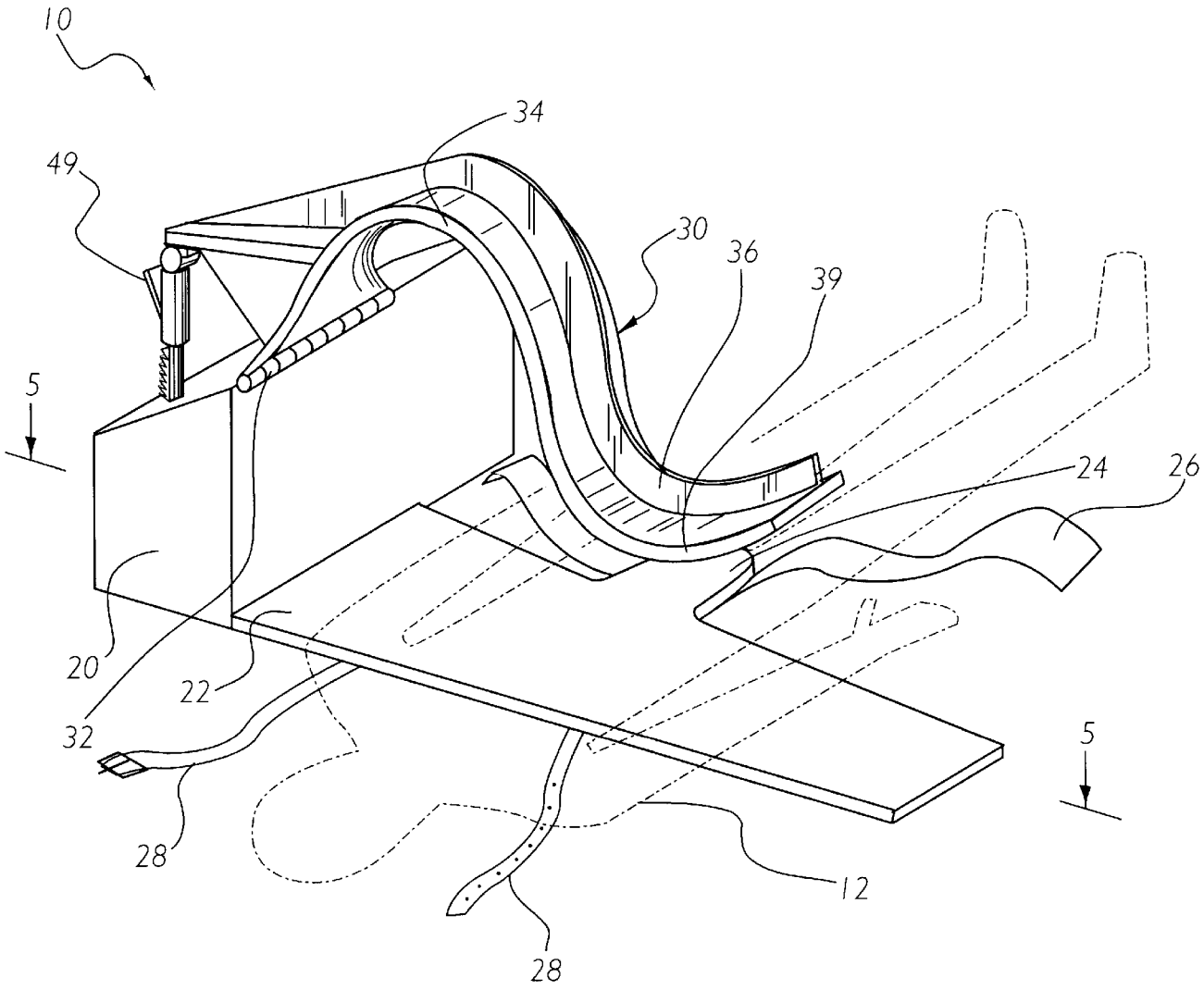
FIG. 1 is an upper perspective view of the present invention.

Turning now descriptively to the drawings, in which similar reference characters denote similar elements throughout the several view, FIGS. 1 through 5 illustrate an automatic cardiac compression system 10, which comprises a housing 20 including a removable board 22 with straps, an arcuate arm 30 pivotally attached to the housing 20, a reciprocating transmission attached to the arcuate arm 30 by an adjustable connector, a variable speed motor 60 mechanically connected to the reciprocating transmission, and an unnumbered battery electrically connected to the variable speed motor 60. The user positions the patient 12 upon the removable board 22 with the sternum positioned directly below the distal end of the arcuate arm 30. The user then manipulates an unnumbered control switch which operates the variable speed motor 60. The motor 60 manipulates the arcuate arm 30 so that the arcuate arm 30 repeatedly engages the patient's chest to provide cardiac compression. After the patient 12 is resuscitated, the user manipulates the switch to terminate power to the motor 60 thereby terminating movement of the arcuate arm 30.

Figure 2:
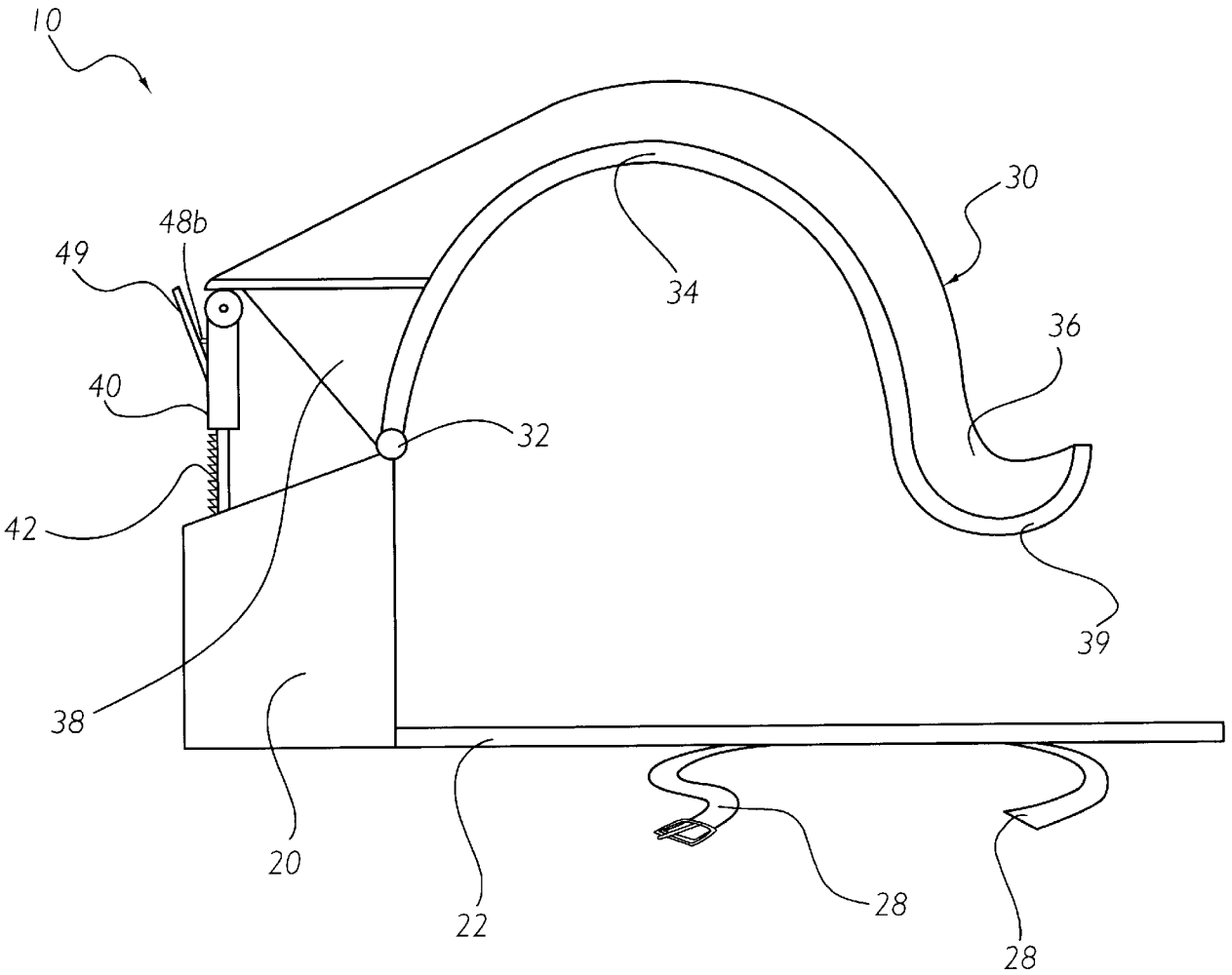
FIG. 2 is a side view of the present invention.

As shown in FIGS. 1 and 2 of the drawings, the board 22 is removably attachable to a lower portion of the housing 20. The board 22 supports the patient 12 above the ground surface for providing a level and clean surface to rest the patient 12 upon. The board 22 is preferably swaged as shown in FIG. 2 of the drawings. A tongue member 24 extends traversely from a side of the board 22 as best shown in FIG. 3 of the drawings for providing additional support to the longitudinal portion of the patient's body during cardiac resuscitation.

Figure 3:
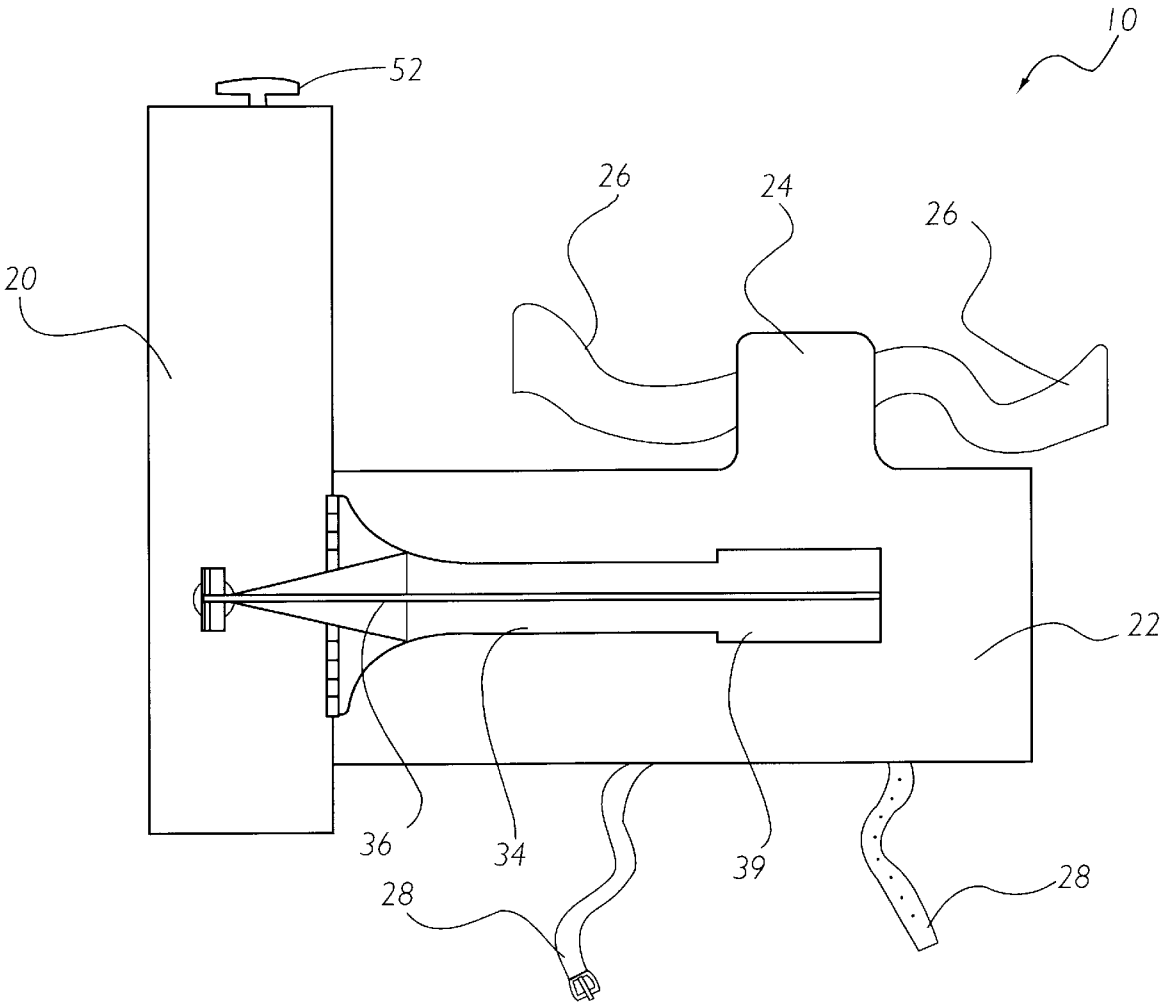
FIG. 3 is a top view of the present invention.

Waist straps are attached to the tongue member 24 as shown in FIG. 3 of the drawings. The waist straps 26 are removably engageable about the patient's waist during operation of the invention to retain the position of the patient 12 relative to the present invention. Further, the waist straps 26 prevent air from being drawn into the stomach that can cause regurgitation during operation of the present invention. A pair of shoulder straps 28 are attached to the side of the board 22 opposite of the tongue member 24 for retaining the position of the upper portion of the patient 12 during operation of the present invention. The shoulder straps 28 and the waist straps 26 all have an unnumbered conventional fastening means such as VELCRO or a buckle.

As best shown in FIG. 2 of the drawings, the arm 30 is pivotally attached to an upper portion of the housing 20 by a hinge 32. The hinge 32 is preferably spring loaded to raise the distal end of the arm 30. The arm 30 is preferably comprised of an elongated arcuate plate 34. A support member 36 is secured along an upper surface of the elongated arcuate plate 34 traversely to support the elongated arcuate plate 34. The distal end of the elongated arcuate plate 34 supports a pressure plate 39 which engages the patient's chest. The pressure plate 39 is preferable arcuate shaped upwardly to form a U-shape. As shown in FIG. 3 of the drawings, the pressure plate 39 is preferably wider than the elongated arcuate plate 34. As shown in FIG. 2 of the drawings, a brace 38 is attached to the support member 36 and the elongated arcuate plate 34 which provides additional support from engagement by the reciprocating transmission. The brace 38 forms a syncline shape with the support member 36 as shown in FIG. 2 of the drawings.

Figure 4:
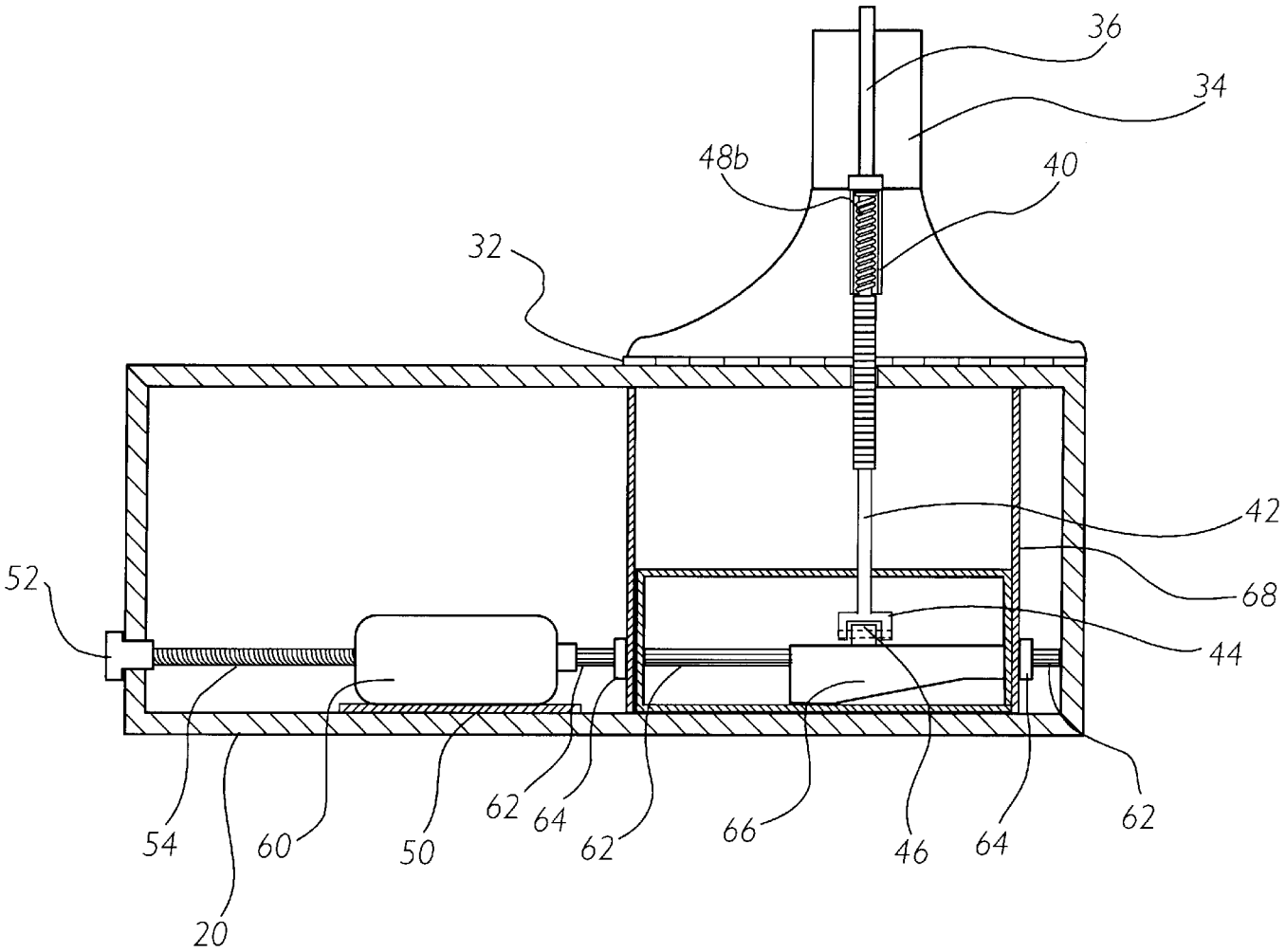
FIG. 4 is a rear cutaway view of the present invention.

As shown in FIG. 4 of the drawings, the reciprocating transmission includes a tube 40 pivotally attached to the brace 38 opposite of the elongated arcuate plate 34. A portion of a notched shaft 42 is slidably retained within the tube 40 as shown in FIG. 4 of the drawings. The notched shaft 42 has an unnumbered flanged end which prevents the shaft from escaping the tube 40. A compression spring 48*b* is mesial the notched shaft 42 and the tube 40 thereby constantly applying force upon the notched shaft 42. A lever 49 is pivotally positioned within the tube 40 with one end in removably engagement with the notches within the notched shaft 42. The lever 49 has a handle which is retained in an engagement position by a compression spring 48*b* as best shown in FIG. 2 of the drawings. The user adjusts the depth of compressions by manipulating the lever 49 to engage the desired level of notch upon the notched shaft 42.

As shown in FIG. 4 of the drawings, a U-shaped bracket 44 is attached to the end of the notched shaft 42 opposite of the compression spring 48*b*. A roller 46 is rotatably retained within the U-shaped bracket 44 which is in engagement with an elliptical cam 66. A cam structure 68 within the housing 20 rotatably supports the elliptical cam 66 as shown in FIGS. 4 and 5 of the drawings.

Figure 5:
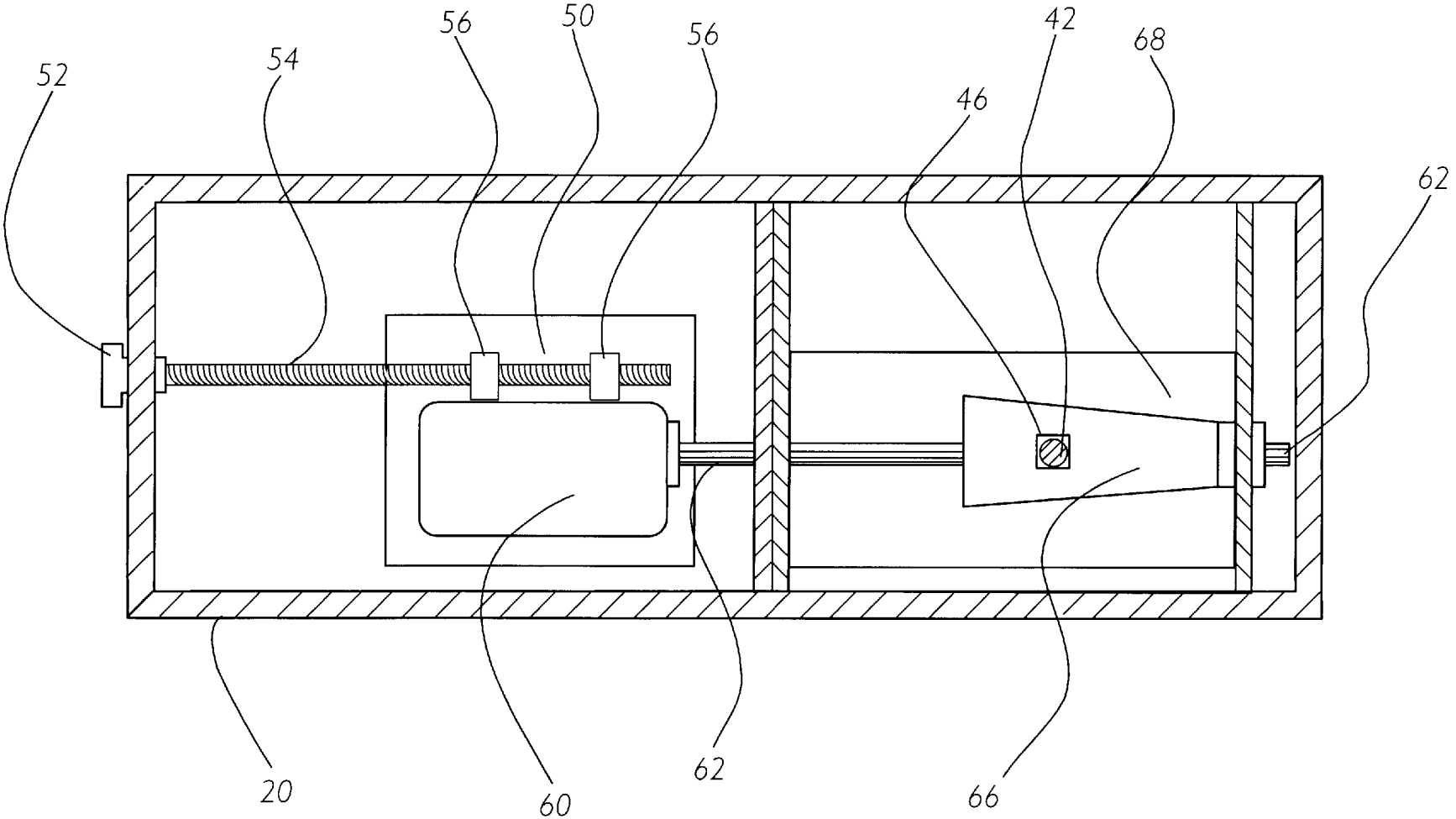
FIG. 5 is a cross sectional view taken along line 5—5 of FIG. 1.

As best shown in FIGS. 4 and 5 of the drawings, a sliding plate 50 is slidably attached within the housing 20. The sliding plate 50 supports the variable speed motor 60. A plurality of interiorly threaded brackets 56 are attached to the sliding plate 50 wherein a threaded shaft 54 is in threaded engagement with the threaded brackets 56. A knob 52 is attached to the end of the threaded shaft 54 and is exposed outside of the housing 20 to allow manual manipulation of the threaded shaft 54 to position the variable speed motor 60 along a desired longitudinal path.

As shown in FIG. 4 of the drawings, a drive shaft 62 extends from the variable speed motor 60 and is rotatably supported by a pair of bearings 64 within the cam structure 68. The elliptical cam 66 is attached coaxially to drive shaft 62 within the cam structure 68 as shown in FIGS. 4 and 5 of the drawings. The opposing ends of the elliptical cam 66 preferably have a circular cross section while the central portion of the elliptical cam 66 has a tapered elliptical cross section. The outer surface of the elliptical cam 66 engages the roller 46 thereby reciprocating the tube 40 which thereby pivots the arm 30 against the patient's chest, thereby supplying cardiac compressions to the patient 12. The user simply adjusts the knob 52 to obtain the desired depth of compressions by positioning the roller 46 upon the desired portion of the elliptical cam 66.

During use, the user would manipulate an unnumbered control switch that would allow various speeds of the variable speed motor 60. The control switch is positioned electrically between a portable power source, such as a battery, and the variable speed motor 60. When finished providing cardiac resuscitation to the patient 12, the user would disengage power to the variable speed motor 60 by manipulating the control switch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic cardiac compression system comprising:

a housing structure;

a board removably attached to a lower portion of said housing structure for supporting a patient;

a motor means within said housing structure;

a reciprocating transmission connected to said motor means; and an arm pivotally attached to said housing structure and connected to said reciprocating transmission, wherein said distal end of said arm repeatedly engages a chest of a patient and wherein said reciprocating transmission comprises a cam mounted upon a drive shaft from said motor means, a cam structure slidably supporting said drive shaft and surrounding said cam, a shaft having an upper end and a lower end, said upper end attached to an extended portion of said arm opposite of said distal end and a roller rotatably attached to said lower end of said shaft for rotatably engaging said cam.

2. The automatic cardiac compression system of claim 1, wherein said reciprocating transmission is configured to have lineal movement which is adjustable in range thereby allowing adjustment of the lineal movement of said distal end of said arm.

3. The automatic cardiac compression system of claim 2, wherein said arm is arcuate shaped.

4. The automatic cardiac compression system of claim 3, wherein said distal end of said arm includes a pressure plate for engaging the chest of a patient.

5. The automatic cardiac compression system of claim 4, wherein said arm has a T-shaped cross section.

6. The automatic cardiac compression system of claim 5, wherein said cam has a tapering elliptical cross section.

7. The automatic cardiac compression system of claim 6, wherein said motor means is secured to a sliding plate within said housing for allowing selective positioning of said cam with respect to roller.

8. The automatic cardiac compression system of claim 7, wherein said board includes a tongue member extending traversely from a side of said board.

9. The automatic cardiac compression system of claim 8, wherein a pair of waist straps are attached to said tongue member.

10. The automatic cardiac compression system of claim 9, wherein a pair of shoulder straps are attached to said board opposite of said tongue member.

11. The automatic cardiac compression system of claim 10, wherein said motor means is variable speed for allowing adjustment of number of compressions per minute.

12. The automatic cardiac compression system of claim 11, including:

at least one interiorly threaded bracket attached to said sliding plate; and a threaded shaft having a knob exposed from said housing threadably attached to said at least one interiorly threaded bracket for allowing manual adjustment of the position of said cam with respect to said roller, thereby allowing regulation of the lineal movement of said shaft.

13. The automatic cardiac compression system of claim 12, wherein:

said shaft is slidably positioned within a tube, wherein said tube is attached to said extended portion of said arm; and a compression spring is positioned within said tube and is in engagement with said shaft.

14. The automatic cardiac compression system of claim 13, wherein:

said shaft includes a plurality of notches; and a spring loaded lever is positioned within said tube and is in selective engagement with said notches of said shaft for allowing adjustment of the lineal movement of said distal end of said arm.

* * * * *